United States Patent [19]

Wiegers

[11] 4,303,285

[45] Dec. 1, 1981

[54] COMBINATION TRASH RECEPTACLE AND CHOPPING BOARD

[76] Inventor: Robert M. Wiegers, 6136 Lamar, Mission, Kans. 66202

[21] Appl. No.: 179,499

[22] Filed: Aug. 19, 1980

[51] Int. Cl.[3] ..... A47R 81/00; B65R 67/00

[52] U.S. Cl. ..... 312/211; 312/237; 232/43.1; 232/43.3

[58] Field of Search ..... 312/211, 237; 232/43.1, 232/43.3, 43.4; 269/289

[56] References Cited

U.S. PATENT DOCUMENTS

| | | | |
|---|---|---|---|
| 814,563 | 3/1906 | Pond | 232/43.5 |
| 1,117,544 | 11/1914 | Barash | 232/43.1 |
| 2,438,785 | 3/1948 | McKallick | 232/43.1 |
| 2,625,973 | 1/1953 | Weldon et al. | 312/211 |
| 2,786,337 | 3/1957 | Spring | 312/237 |
| 2,916,183 | 12/1959 | Ariens | 312/211 |
| 3,443,745 | 5/1969 | Kleeberg | 312/211 |
| 3,922,046 | 11/1975 | Schneider | 312/211 |
| 3,995,924 | 12/1976 | Jones | 312/211 |
| 4,218,103 | 8/1980 | Bacskay | 312/211 |

FOREIGN PATENT DOCUMENTS

| | | | |
|---|---|---|---|
| 915595 | 11/1972 | Canada | 312/211 |

*Primary Examiner*—Victor N. Sakran
*Attorney, Agent, or Firm*—John A. Hamilton

[57] ABSTRACT

A combination trash receptacle and chopping board comprising a cabinet adapted to carry trash bag therein having its open mouth just below the top of the cabinet, and a front door for removal of the bag, the top of the cabinet being formed by a chopping board hinged at its rearward edge to the cabinet to permit insertion of the trash bag, the chopping board being divided into front and rear sections, the front section being hinged to the rearward section to be raised for insertion of trash into the bag, and being forwardly movable to open a slot between the sections so that choppings from both sections may be swept through the slot into the bag.

9 Claims, 9 Drawing Figures

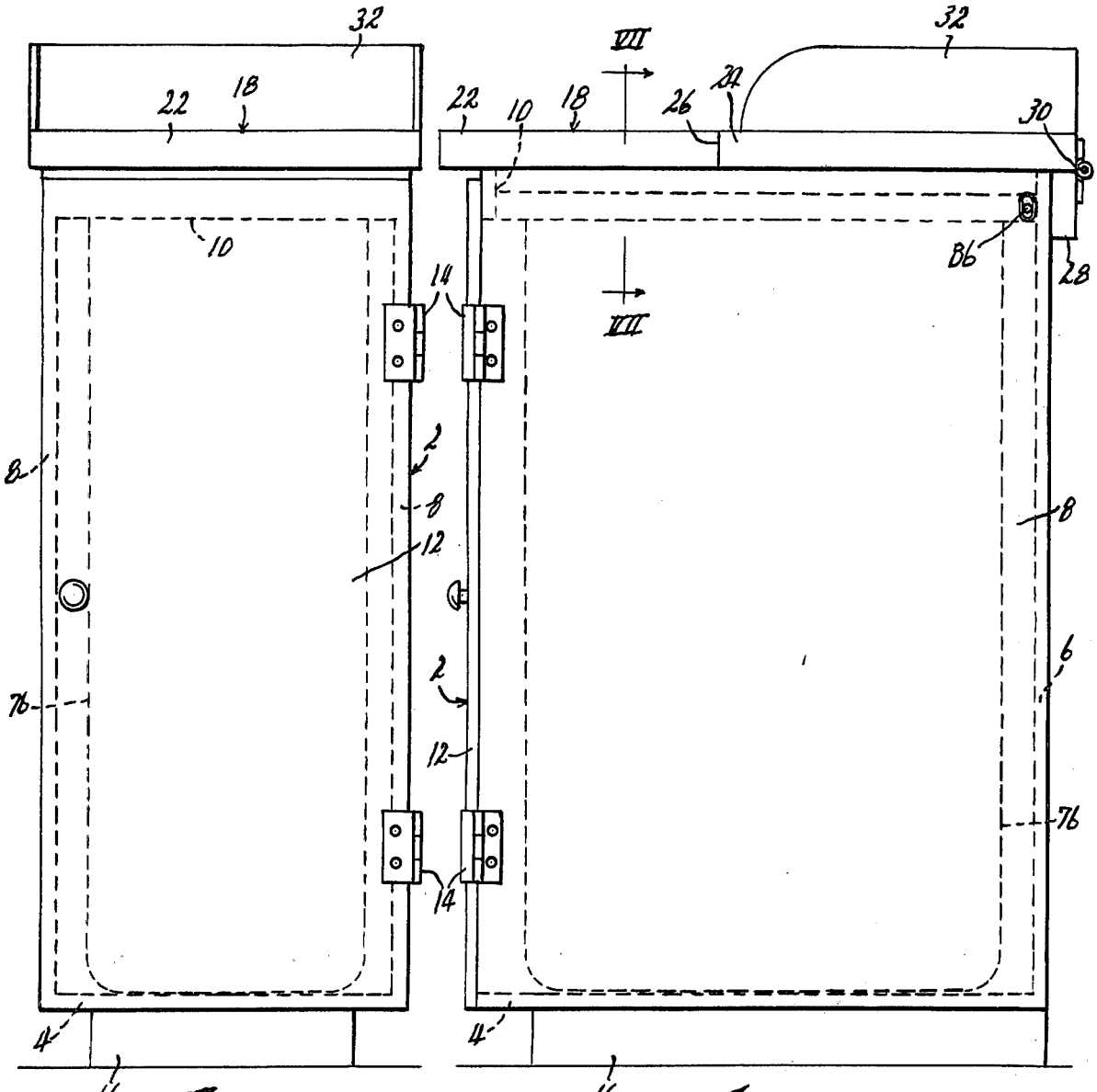
Fig. 1
Fig. 2
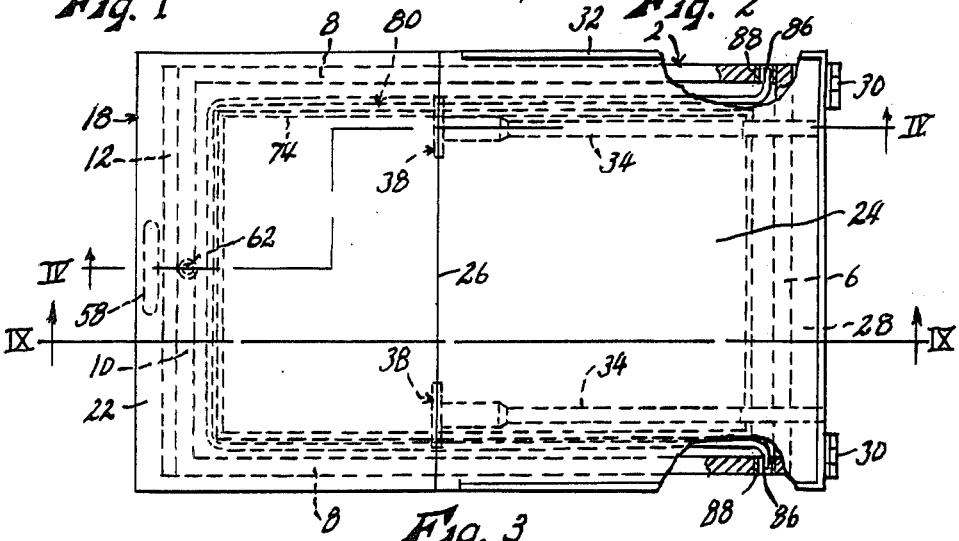
Fig. 3

COMBINATION TRASH RECEPTACLE AND CHOPPING BOARD

This invention relates to new and useful improvements in kitchen appliances, and has particular reference to waste receptacles and chopping boards, both of which are necessary appliances in virtually any kitchen, and still more particularly to a combination waste receptacle and chopping board.

The principal object of the present invention is the provision of a cabinet, preferably of counter height, adapted to carry an ordinary plastic trash bag therein with the open mouth of the bag just below the top of the cabinet, the top of the cabinet constituting a chopping board which may be hingeably raised both to permit the insertion of fresh trash bags when necessary, and also to provide easy access for deposit of trash in the bag.

Another object is the provision of a device of the character described having novel means for securing the trash bag in a wide open position for the reception of trash therein.

A further object is the provision of a device of the character described in which the chopping board, which inherently must be rather heavy, is divided so that only a portion thereof need be raised to deposit trash in the bag.

A still further object is the provision of a device of the character described in which the chopping board is divided into sections which are relatively movable to open a slot disposed directly above the trash bag, so that the refuse of chopping performed on said board may be swept from all areas of the board through said slot and into said bag.

Other objects are simplicity and economy of structure, efficiency and dependability of operation, and ease and convenience of use.

Figure 4:
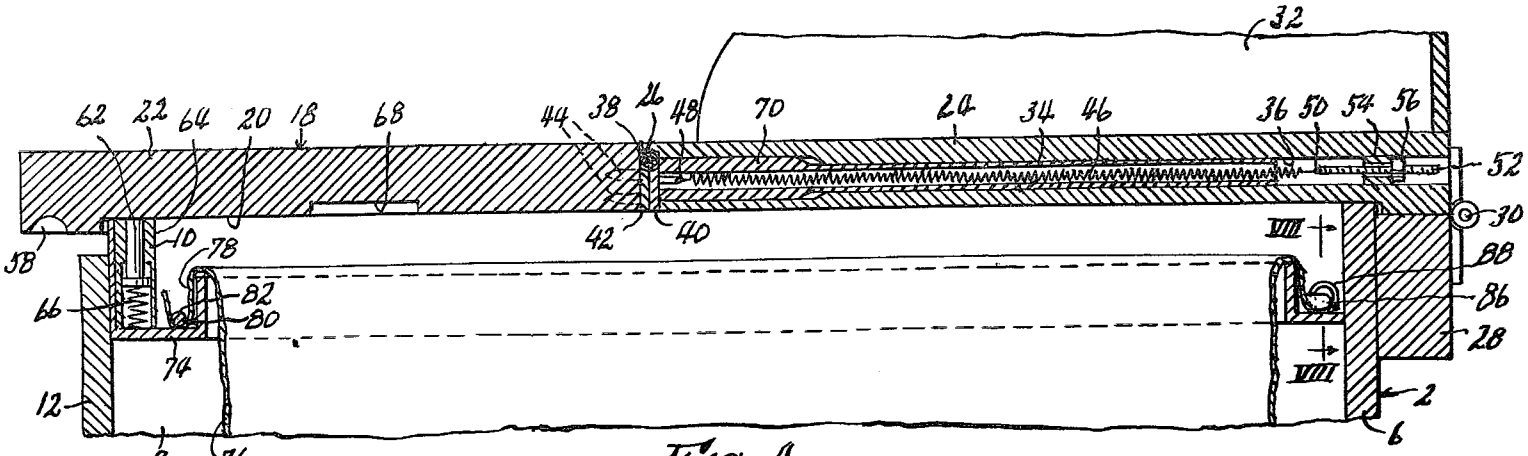
Figure 5:
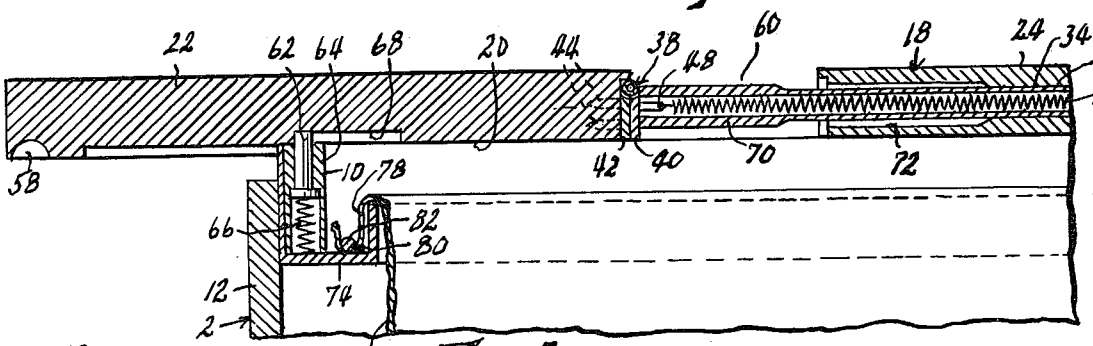
Figure 6:
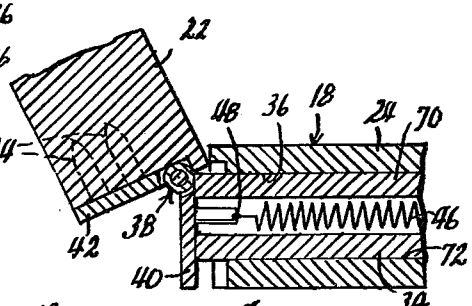
Figure 8:
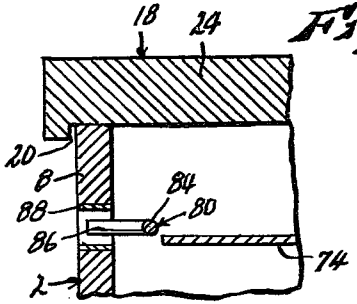
Figure 7:
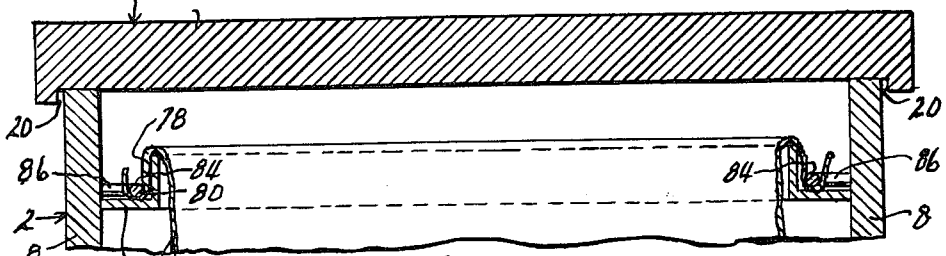
Figure 9:
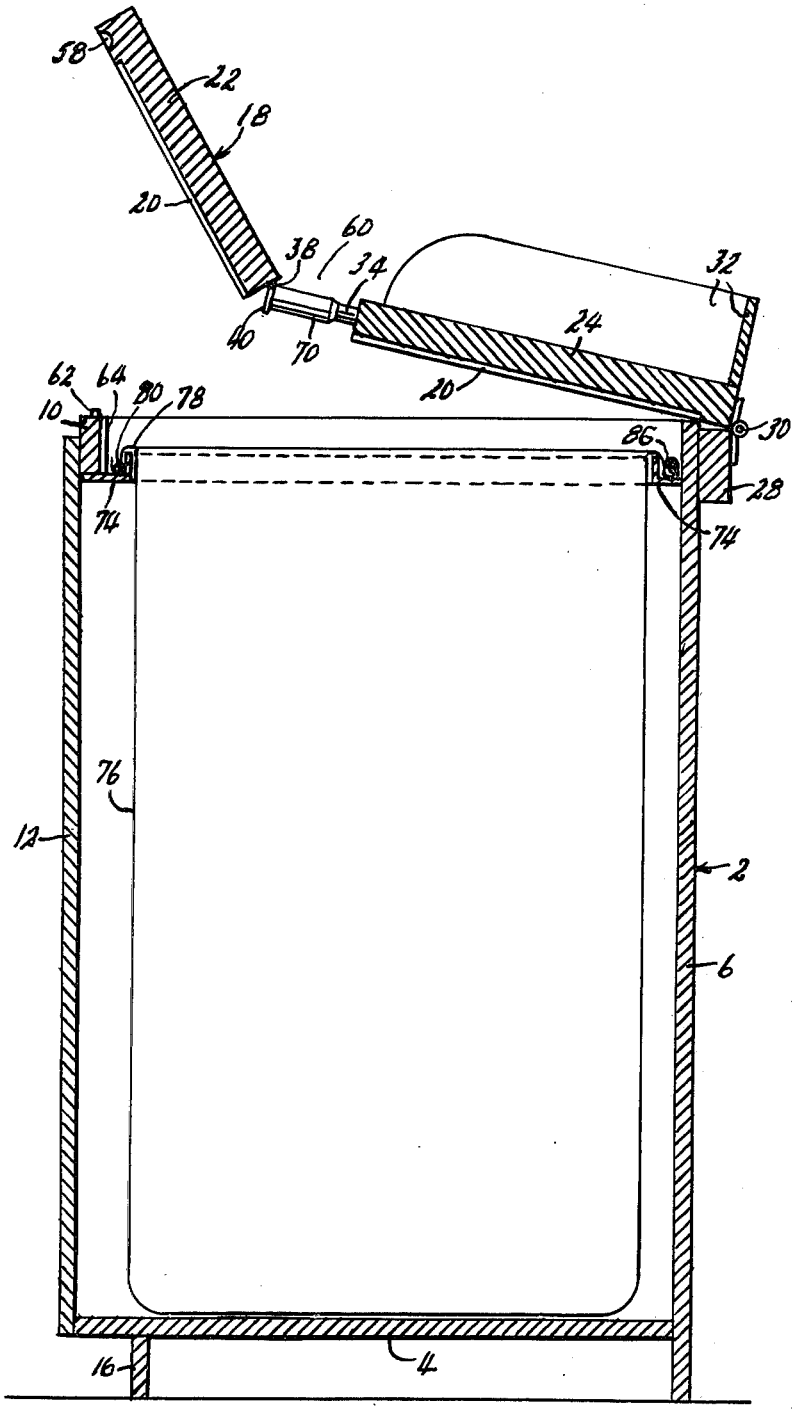

With these objects in view, as well as other objects which will appear in the course of the specification, reference will be had to the accompanying drawing, wherein:

FIG. 1 is a front elevational view of a combination waste receptacle and chopping board embodying the present invention, FIG. 2 is a side elevational view of the device as shown in FIG. 1, FIG. 3 is a top plan view of the device, with portions broken away, FIG. 4 is an enlarged, fragmentary sectional view taken on line IV—IV of FIG. 3, FIG. 5 is a fragmentary view similar to FIG. 4, with the forward chopping board section moved forwardly, FIG. 6 is an enlarged, fragmentary view similar to FIG. 4, showing the forward chopping board section pivoted upwardly, FIG. 7 is an enlarged, fragmentary sectional view taken on line VII—VII of FIG. 2, FIG. 8 is an enlarged, fragmentary sectional view taken on line VIII—VIII of FIG. 4 and, FIG. 9 is a sectional view taken generally on line IX—IX of FIG. 3, with the chopping board tilted upwardly and with its front section extended and tilted further upwardly.

Like reference numerals apply to similar parts throughout the several views, and the numeral 2 applies generally to a cabinet which as will appear supports and carries a trash bag and a chopping board. Said cabinet is preferably of standard counter height and is generally rectilinear, having a floor 4, rear wall 6, side walls 8, and an upper abbreviated front wall 10, the main portion of its front being closed by a door 12 hinged to one of side walls 8 at 14. Said cabinet is supported by a recessed base 16 providing a "toe space" at the front and sides of the cabinet.

The top of cabinet 2 is formed by a chopping board designated generally by the numeral 18, formed preferably of a hardwood of a suitable type, which renders it rather thick and heavy. Said board covers the entire top of the cabinet, and extends outwardly therefrom in all directions, its top surface being planar and horizontal, and its bottom surface being recessed, as indicated at 20, to engage downwardly around the side, front and rear walls of the cabinet. It is divided laterally to form a front section 22 and a rear section 24, which normally abut smoothly along line 26. Rear section 24 is pivoted at its rearward edge, on a horizontal transverse axis, to a block 28 affixed to rear cabinet wall 6, as by hinges 30, so that it may be pivoted upwardly and rearwardly. Said rear board section may also be provided with an upstanding fence 32 along the side and rear edges thereof, in order to retain food choppings thereon. Front board section 22 is connected to rear section 24 by a pair of tubular slide bars 34 which extend forwardly and rearwardly of the board in parallel relation to each other, extending slidably in bores opening through both the forward and rearward edges of said board section. The forward end of each slide bar is connected to front board section 22 by a leaf hinge 38, said hinges being coaxial on a horizontal transverse axis. The forward end of the slide bar is welded or otherwise affixed to the rear leaf 40 of said hinge, and the front hinge leaf 42 is affixed to front board section 22 as by screws 44. The hinge is offset below the top surfaces of the board sections, and is countersunk therein, in order that the board sections may abut firmly together at line 26. A tension spring 46 is disposed in each slide bar, being affixed at its forward end to rear hinge leaf 40, as indicated at 48, and extends at its rearward end from said bar, being affixed at its rearward end, as indicated at 50, to the forward end of an elongated screw rod 52 disposed coaxially in bore 36. Said rod extends slidably through a block 54 fixed in said bore, and has a nut 56 threaded thereon behind said block. By inserting a socket wrench into the rearward end of bore 36 to engage and turn nut 56, the tension of spring 46 may be adjusted.

Thus springs 46 bias forward board section 22 rearwardly at all times, toward abutment with section 24. Board section 22 may be pulled forwardly against said springs, being provided with a finger groove 58 in its lower surface adjacent its forward edge for this purpose. This forward movement of section 22 opens a slot 60 between the board sections, as indicated in FIG. 5. When this slot has been opened to a predetermined degree, the forward board section is latched by a vertical latch pin 62 (see FIGS. 4 and 5) carried slidably in a barrel 64 mounted in front cabinet wall 10 at the top of the cabinet. When forward portion 22 of the board has been pulled forwardly to a predetermined distance, said latch pin is urged upwardly by a spring 66 to snap into a socket 68 provided therefore in the lower surface of said board section, thereby holding slot 60 open. Board section 22 may be disengaged from the latch pin by tilting said board section slightly upwardly on hinge 38, whereupon board section 22 is again pulled rearwardly by springs 46 to abut section 24. Rearward movement of board section 22 is slowed by the fact that the forward end portions 70 of slide bars 34 are of increased diameter, and engage snugly but slidably in correspondingly enlarged forward end sections 72 of bores 36 of board section 24. This constitues a dashpot arrangement, board section 22 being allowed thereby to move rearwardly only as rapidly as air is allowed to escape from bore sections 72.

Just below chopping board 18, a narrow, upwardly opening trough 74 is carried in cabinet 2 around the entire internal periphery thereof, being affixed to the inner surfaces of rear wall 6, side walls 8 and front wall 10. This trough should obstruct the top opening of the cabinet as little as is practically possible. An ordinary pliable plastic trash bag 76, a standard 30-gallon bag being well adapted for the purpose, is disposed within the cabinet, occupying most of the volume thereof and extending to its floor. The lip 78 of the bag around its open upper end is pulled upwardly through the interior opening of trough 74, then folded outwardly and downwardly into said trough as shown, where it is engaged and held by a weight bail 80. Said bail is formed of heavy rod steel, and is of U-form, having a front reach 82 resting in the front portion of trough 74, and side reaches 84 resting in the side portions of the trough. At the rearward end of each side portion 84, the rod is bent outwardly to form a pintle 86 engaged pivotally in a grommet 88 set into the associated cabinet side wall 8. Said grommets are vertically elongated to permit pintles 86 to move vertically therein, in order to insure that the bail may rest evenly in trough 74. The bail is of sufficient weight to hold lip 78 of the trash bag firmly in place, so long as it is not required to support the weight of a loaded bag.

Use and operation of the device is believed to be obvious. To ready it for use, chopping board 18 is raised upwardly and rearwardly on hinges 30 to open the top of the cabinet fully, and bail 80 is likewise pivoted upwardly and rearwardly. A trash bag 76 is then inserted downwardly into the cabinet, and its lip 78 folded into trough 74 and secured therein by lowering bail 80 into said trough, as described. The chopping board may then be lowered to its horizontal position, and the device is ready for use.

After any chopping of food on the top surface of board 18, front board section 22 may be pulled forwardly and latched forward by latch pin 62, thereby opening slot 60 between the board sections, as indicated in FIG. 5, whereupon any waste choppings from either or both board sections may conveniently be swept through said slot directly into trash bag 76. The forward board section 22 may then be tilted slightly upwardly on hinges 38 to free it from latch pin 62, whereupon it is again pulled rearwardly by springs 46 to abut rear board section 24. This rearward movement of the front board section is slowed and cushioned by the dashpot action of enlarged sections 70 of slide bars 34 in sections 72 of bores 36, thereby eliminating any reasonable likelihood that the user's fingers will be painfully pinched between the board sections. Without this provision, the front board section would move rearwardly very rapidly, and due to its weight would inflict a substantial hammer blow to the user's fingers if they were between the board sections.

Front board section 22 may also be pivoted upwardly on hinges 38 to a much greater degree, as indicated in FIG. 6. This provides access for depositing ordinary kitchen trash of any sort into trash bag 76, without necessity of lifting the entire chopping board, which may be of very considerable weight. Also as shown in FIG. 6, pivoting front board section 22 upwardly as described extends slide bars 34 slightly forwardly against springs 46, since the hinge axis is offset below the top board surfaces. However, when front board section 22 is again lowered, it is immediately drawn back into abutting relation with section 24 by springs 46. The adjustment of the tension of springs 46 provided by screws 52 and nuts 56 permits accomodation for certain variable factors, such as the strength of the springs and the closeness of fit of the slide bars in their bores.

When the trash bag is full, or nearly full, the user may open door 12 on hinges 14, reach into the cabinet to pull the lip 78 of the bag from under bail 80, and withdraw the bag through the front of the cabinet, whereupon it may be tied and disposed of in the usual manner. Removal of the bag through the front of the cabinet rather than through its top is preferred both since it permits withdrawal of the bag without the obstruction which trough 74 would offer to top withdrawal, and also since front removal eliminates any necessity for lifting the bag, which may be quite heavy when loaded, to the height which would be required for top removal.

While I have shown and described a specific embodiment of my invention, it will be readily apparent that many minor changes of structure and operation could be made without departing from the spirit of the invention.

What I claim as new and desire to protect by Letters Patent is:

1. A combination trash receptacle and chopping board comprising:

a. a hollow cabinet, b. a horizontal chopping board forming the top wall of said cabinet and being hinged to said cabinet at its rearward edge to open upwardly, and comprising a rear section, a front section normally smoothly abutting said rear section, and means connecting said front and rear sections and operable to permit planar movement of said front section relative to said rear section, whereby to open a slot therebetween through which access may be had to the interior of said cabinet, and c. means operable to support a pliable trash bag in said cabinet with its open top disposed just below the slot opened in said chopping board by forward movement of the front board section.

2. The structure as recited in claim 1 wherein said connecting means is additionally operable to permit upward and rearward pivoting of said front board section relative to said rear board section, at all positions in the front-to-rear movement of said front board section.

3. The structure as recited in claim 1 with the addition of:

a. manually operable latch means operable to secure said front board section releasably in a forwardly spaced relation from said rear board section, whereby to maintain the slot therebetween open, and b. spring means biasing said front board section rearwardly, whereby said front board section is returned to abutting relation with said rear board section whenever said latch means is released.

4. The structure as recited in claim 3 with the addition of means operable to adjust the tension of said spring means.

5. The structure as recited in claim 3 with the addition of dashpot means operable to cushion and slow the rearward movement of said front board section.

6. A combination trash receptacle and chopping board comprising:

a. a hollow cabinet, b. a horizontal chopping board forming the top wall of said cabinet and comprising a rear section hinged at its rearward edge to said cabinet on a horizontal transverse axis, a front section normally smoothly abutting said rear section, and means connecting said front and rear sections and including hinges parallel to said rear section hinges and operable to permit upward and rearward tilting of said front section relative to said rear section, and c. means operable to support a pliable trash bag in said cabinet with the top opening of said bag disposed just below said chopping board, whereby by tilting said front board section upwardly, access to said trash bag may be had without lifting the entire chopping board.

7. The structure as recited in claim 6 wherein said connecting means comprises:

a. a plurality of slide bars carried by said rear board section for forward and rearward sliding movement parallel to the plane of said rear board section, one of said front board section hinges being connected to the forward end of each of said slide bars and to said front board section, whereby said front board section may be tilted upwardly and rearwardly, b. spring means biasing each of said slide bars rearwardly, whereby said front board section is urged toward an abutting relation with said rear board section, but may be moved forwardly against said spring means to open a slot between said board sections, and c. an upwardly biased latch pin carried by said cabinet and operable to engage and secure said front board section in a forward position to maintain said slot open, said front board section being disengageable from said latch pin by upward tilting of the former.

8. The structure as recited in claim 7 with the addition of means operable to adjust the tension of said spring means.

9. The structure as recited in claim 7 wherein each of said slide bars is movable in a bore formed therefor in said rear board section, said bore having an enlarged portion opening through the forward edge of said rear board section, and wherein each of said slide bars has an enlarged portion as its forward end operable to enter and move snugly in said enlarged bore portion during the rearward movement of said front board section by said spring means, whereby to cushion and retard said rearward movement.

* * * * *